United States Patent [19]

Montell

[11] 4,233,918

[45] Nov. 18, 1980

[54] METHOD OF MAKING A RUG

[75] Inventor: Joseph J. Montell, Laguna Beach, Calif.

[73] Assignee: Rug Crafters, Santa Ana, Calif.

[21] Appl. No.: 954,548

[22] Filed: Oct. 25, 1978

Related U.S. Application Data

[63] Continuation-in-part of Ser. No. 810,038, Jun. 27, 1977.

[51] Int. Cl.[3] ..... D05C 15/00

[52] U.S. Cl. ..... 112/266.2

[58] Field of Search ..... 112/410, 411, 266.1, 112/9, 262.1, 265.1, 266.2; 428/92, 103; 223/46

[56] References Cited

U.S. PATENT DOCUMENTS

| | | | |
|---|---|---|---|
| 2,150,023 | 3/1939 | Clack | 112/411 X |
| 2,429,281 | 10/1947 | Solins | 112/9 |
| 2,466,016 | 4/1949 | Fallek | 112/411 |
| 2,904,871 | 9/1959 | Wolff | 112/411 X |
| 3,168,883 | 2/1965 | Ploch | 112/411 |
| 3,225,725 | 12/1965 | Casselli | 112/410 |
| 3,602,173 | 8/1971 | Estabrook | 112/411 |

FOREIGN PATENT DOCUMENTS

| | | | |
|---|---|---|---|
| 236272 | 1/1925 | United Kingdom | 112/411 |

*Primary Examiner*—H. Hampton Hunter
*Attorney, Agent, or Firm*—Gordon L. Peterson

[57] ABSTRACT

A method of making a rug comprising attaching a plurality of tying elements to a rug backing, wrapping the tying elements around central regions of bundles of strands and tying knots in the tying elements to attach the bundles of strands to the rug backing.

17 Claims, 9 Drawing Figures

FIG. 1.
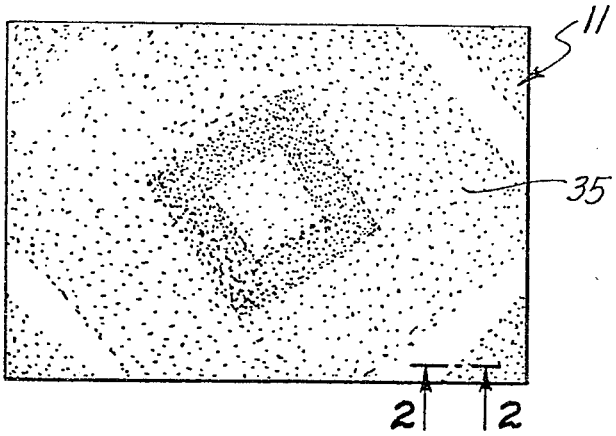
FIG. 2.
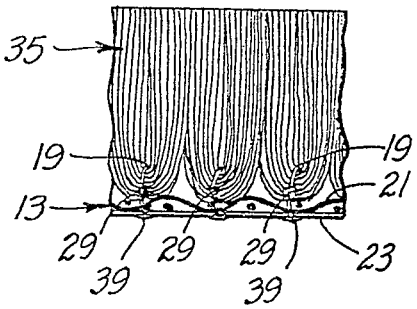
FIG. 3.
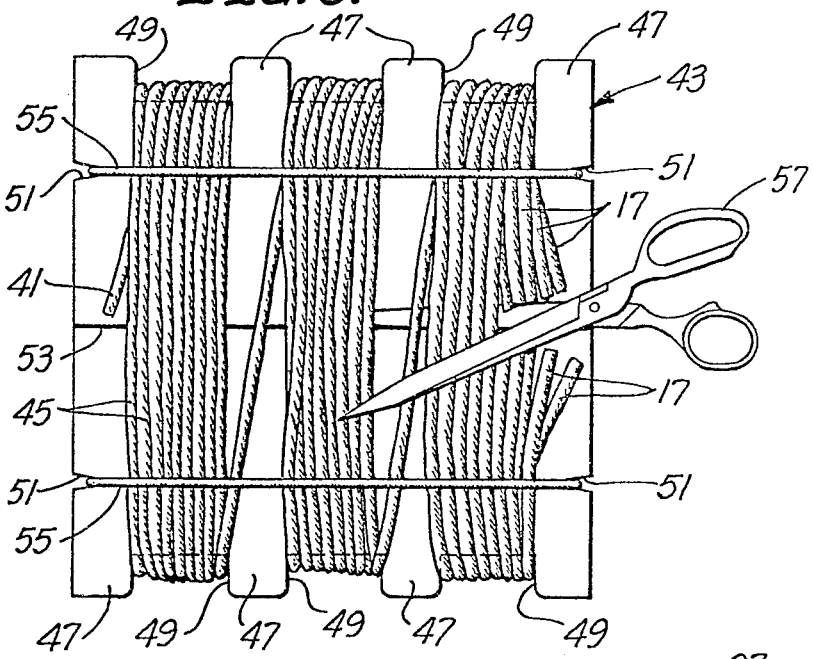
FIG. 4.
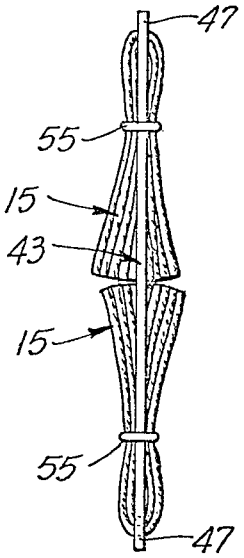
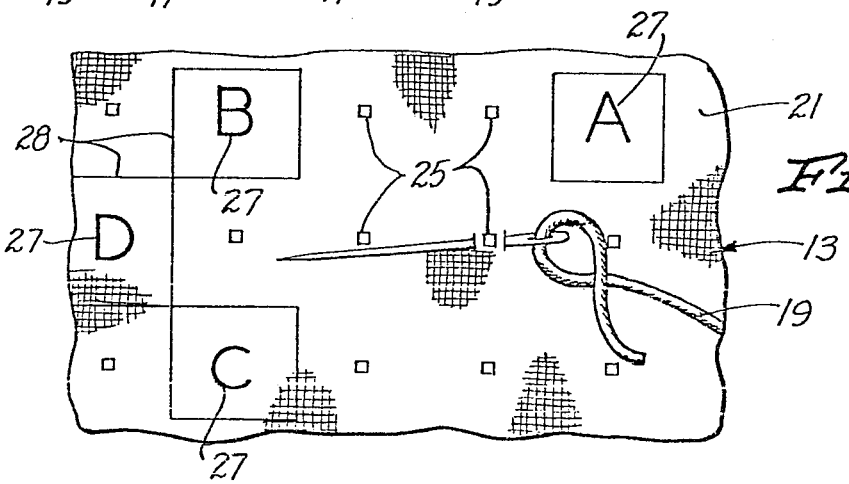
FIG. 5.

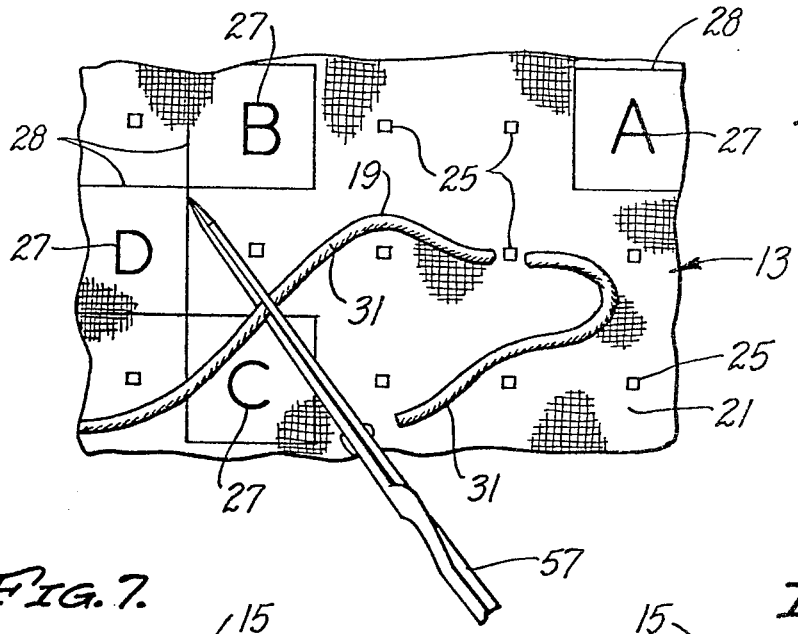
FIG. 6.
FIG. 7.
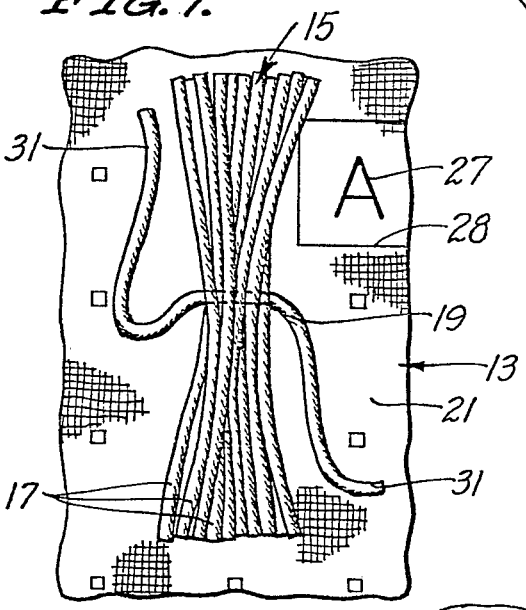
FIG. 8.
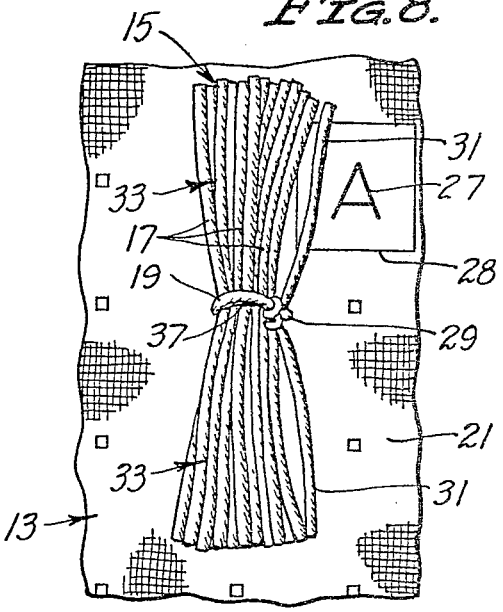
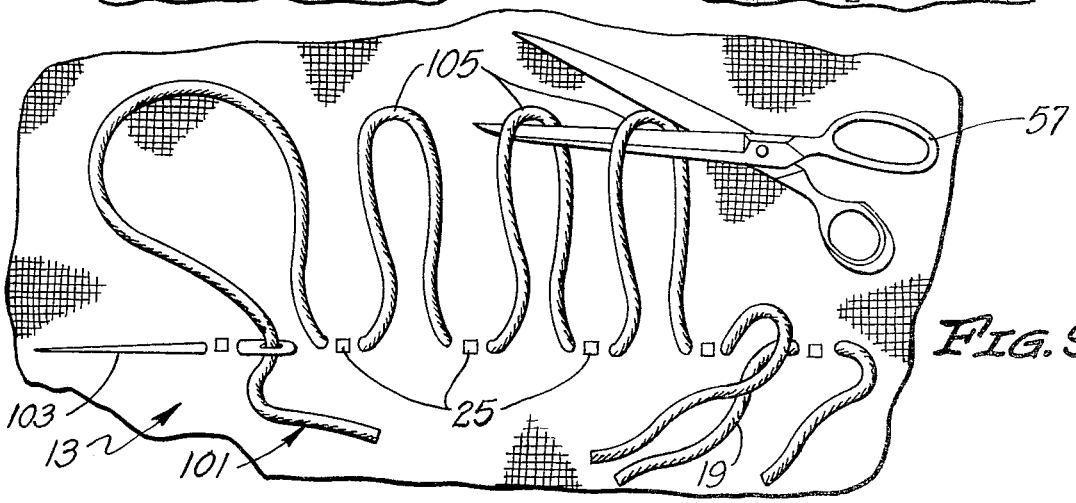
FIG. 9.

METHOD OF MAKING A RUG

This application is a continuation-in-part of my copending application Ser. No. 810,038 filed June 27, 1977, and entitled RUG AND METHOD OF MAKING THE SAME.

BACKGROUND OF THE INVENTION

Rug making by the home craftsman has become a popular hobby. Various techniques are employed by the home craftsman to make rugs. Typically, these techniques involve the use of hand operated tools, such as a tufting tool, a latching hook, etc. While these tools provide fine products, particularly for the more skilled craftsmen, there is a need for a high-quality rug which can be easily made by the unskilled craftsman.

SUMMARY OF THE INVENTION

The present invention provides a rug which can be made by one totally unskilled in the rug making art. No tufting tool, latching hook or other rug making tool is required. Rugs of this invention can also be easily made on a commercial scale for resale.

These, and other advantages, can be obtained by simply tying a plurality of bundles of strands to a rug backing using a plurality of elongated flexible tying elements. More particularly, the rug may include a rug backing having a forward face and a back face and a plurality of bundles of strands. The tying elements are attached to the rug backing. Each of the tying elements is wrapped around a central region of at least one of the bundles and tied into a knot to attach the bundles to the forward face of the rug backing. Accordingly, each of the bundles forms two clumps of the pile for the rug.

Although the tying elements can be attached to the rug backing in various different ways, this can be simply and inexpensively accomplished by sewing each of the tying elements onto the rug backing.

Preferably, the end portions of each of the tying elements project from the forward face of the rug backing. This permits the knot to be on the forward face of the rug. More importantly, however, this permits the end portions of the tying element to extend beyond the knot to form two additional strands of the associated bundle. Thus, each of the tying elements serves the dual purpose of attaching a bundle of the strands to the rug backing and forming a portion of the strands of such bundle. Preferably the end portions of the tying element are of an appropriate length so that these end portions terminate at the ends of the other strands of the bundle.

Each of the tying elements is preferably wrapped around, or part way around, a central region of the associated bundle. After the knot has been tied, the bundle forms two separate clumps of pile of substantially identical length. The knot is preferably below or on the side of the associated bundle so it is protected, not readily visible, and not noticeable when the rug is in use.

Indicia on the rug backing can be used to indicate the approximate location at which each of the tying elements is to be sewed onto the rug backing. This assures proper spacing of the bundles and assures that the pile will be evenly distributed. In addition, the indicia can be used to obtain various patterns and colors.

To prevent the strands from being pulled out of the rug, a small amount of adhesive can be placed between each of the bundles and the associated tying element. In addition, to prevent the tying element from slipping relative to the rug backing and to protect the tying element from wear, a small amount of adhesive can be placed over the portion of the tying element on the back face of the rug backing.

Another advantage of this invention is that the length of pile is variable over a very wide range. Specifically, pile length is controlled by the length of the strands in the bundles, and this can be easily changed. For example, the rug of this invention can have a very long pile and be made very plush by using relatively long strands in the bundle.

The strands of a bundle can be of the same or different lengths. However, the rug can be made faster if the strands of a bundle are all of the same length.

A preferred way of making the strands is to wind a continuous filament around a template a multiplicity of times to form a plurality of loops. Each of the loops is then cut one or more times to provide strands of the desired length. The template can be marked with suitable indicia, such as one or more cutting lines, indicating where the cut should be made to provide strands of a specified length.

A more rapid way of attaching the tying elements to the rug backing is to sew a tying element strand into the rug backing to form a plurality of loops on the forward face of the rug backing. The tying element strand is sewed to, and therefore attached to, the rug backing intermediate each of the loops. The tying element strand is then cut at each of the loops to thereby form several of the tying elements. This more rapid method of providing the tying elements is particularly adapted for use when several bundles of the same color are to be consecutively attached to the rug backing. This enables the tying element strand and the bundles to be of the same color and taken from the same ball of yarn.

The invention, together with further features and advantages thereof, may best be understood by reference to the following description taken in connection with the accompanying illustrative drawing.

BRIEF DESCRIPTION OF THE DRAWING

FIG. 1 is a plan view of a rug constructed in accordance with the teachings of this invention.

FIG. 2 is an enlarged, fragmentary sectional view taken generally along line 2—2 of FIG. 1.

FIG. 3 is a plan view of a template having a continuous filament wound on it and illustrating a preferred way of providing bundles of strands.

FIG. 4 is an end elevational view of the template after the loops have been cut to form bundles of strands.

FIG. 5 is a fragmentary plan view showing how one of the tying elements can be sewed into the rug backing.

FIG. 6 is a fragmentary plan view of the rug backing and one of the tying elements sewed into the rug backing.

FIG. 7 is a fragmentary plan view showing the positioning of a bundle of strands on an associated tying element.

FIG. 8 is a fragmentary plan view showing the backing element with one of the bundles tied to the rug backing.

FIG. 9 is an elevational view of the rug backing and a tying element strand illustrating how several tying elements can be provided from a single tying element strand.

DESCRIPTION OF THE PREFERRED EMBODIMENT

FIG. 1 shows a rug 11 constructed in accordance with the teachings of this invention. Generally, the rug 11 includes a rug backing 13, bundles 15 (FIG. 8) of strands 17 and a plurality of tying elements 19 (FIGS. 2, 7 and 8) for attaching the bundles to the rug backing.

In the embodiment illustrated, the rug backing 13 is a broad, strong sheet of woven fabric having a forward face 21 which faces upwardly when the rug 11 is on the floor and a back face 23. As shown, for example, in FIGS. 5–8, the forward face 21 has indicia, such as the dots 25 and letters 27 within squares 28. These indicia are used as described hereinbelow in the making of the rug 11.

Each of the tying elements 19 is suitably attached to the rug backing 13. In the embodiment illustrated, each of the tying elements 19 is sewed onto the rug backing 13. Each of the tying elements 19 extends completely around an associated bundle 15 and is tied into a knot 29 (FIG. 8), such as a square knot, to firmly attach the bundle to the rug backing 13. The knots 29 are preferably tied as far under the bundle as is possible so that the knot contacts the forward face 21 of the rug backing 13 as shown in FIG. 2. End portions 31 of the tying element 19 project beyond the knot 29 to form additional strands of the bundle 15 as shown in FIG. 8.

Each of the bundles 15 includes a multiplicity of the strands 17. The strands 17 may be of any suitable rug making material or yarn, such as wool or a synthetic material. Perferably, all of the strands 17 of a bundle 15 are of the same length, although the length of the strands 17 may change from bundle to bundle if the pattern of the rug so requires. The tying elements 19 are wrapped around a central region of the bundles 15 so that each of the bundles forms two clumps 33 (FIG. 8) of the pile 35 for the rug 11. Because the strands 17 can be of any desired length, the pile 35 may be long and plush as illustrated in FIG. 2.

Adhesive 37 (FIG. 8) can be placed around the area of contact between the tying element 19 and the bundle 15 to prevent the strands from pulling out of the bundle within the tying element. Adhesive 39 (FIG. 2) may be placed on the back face 23 along the area of contact between the rug backing 13 and the tying element 19 to prevent slippage of the tying element relative to the rug backing and to protect the portion of the tying element on the back face.

The first step in making the rug 11 is to make a plurality of the bundles 15. Although this can be accomplished in different ways, a preferred method is shown in FIGS. 3 and 4. A continuous filament 41 is wound around a template 43 to form a plurality of loops 45. The filament 41 is yarn or thread of the material of which the strands 17 are to be formed.

Although the template 43 may be of various different constructions, in the embodiment illustrated, it includes a flat plate having spaced projections 47 at the opposite ends thereof defining notches 49. The side edges of the template 43 have recesses 51. Indicia in the form of a cutting line 53 extends transversely across the template 43 half way between the upper and lower edges thereof as viewed in FIG. 3.

As shown in FIG. 3, the filament 41 is wound around the template 43 at the notches 49. The loops 45 are held in place by rubber bands 55, or other suitable means, which are in turn held in position by the recesses 51.

To form the loops 45 into the bundles 15, the loops are cut along the cutting line 53 by any suitable means, such as scissors 57. The bundles resulting from cutting along the cutting line 53 would contain strands 17 of relatively long length. To make these strands 17 of half this length and to double the number of the bundles 15, the loops may again be cut along a cutting line (not shown) corresponding to the cutting line 53 on the opposite face of the template 43. This forms the bundles 15 as shown in FIG. 4. If desired, additional cutting lines may be provided on the template 43 to make additional bundles of shorter strands. Also, additional templates 43 of different sizes can be provided to facilitate the making of bundles of strands 17 of different lengths and bundles containing a greater or larger number of the strands 17. Of course, the number of strands 17 per bundle 17 can be controlled by counting the number of the loops 45 which are wound on the template 43.

As indicated above, the tying elements 19 are preferably sewed into the rug backing 13 as shown in FIGS. 5 and 6. In the embodiment illustrated, the indicia in the form of the dots 25 indicate the locations at which one of the tying elements 19 is to be sewed into the rug backing 13. The indicia in the form of the letters 27 can be used, for example, to indicate the color of the strands that are to be used for the bundle 15 to be attached to the rug backing 13 within the associated square 28. The squares 28 are sufficiently small so that the tying element 19 can be easily sewed to the center of square.

The tying element 19 is preferably sewed into the rug backing 13 so that the end portions 31 are on the forward face 21 of the rug backing. The tying elements 19 may be cut to length before they are sewed into the rug backing 13, or they may be sewed into the rug backing and then cut to length using the scissors 57 as shown in FIG. 6. Preferably, each of the tying elements 19 is of the same material and color as the strands 17 of the bundle 15 which it is to attach to the rug backing 13.

After the tying element 19 is sewed into the rug backing 13, one of the bundles 15 is placed on the forward face 21 of the rug backing 13 so that a central region of the bundle overlies the tying element 19. Preferably the strands 17 of the bundle 15 are arranged so that the ends of the strands are even.

Next, the tying element 19 is tied to form the knot 29 as shown in FIG. 8. The end portions 31 of the tying element 19 are used to form a part of the bundle 15 and are preferably of about the same length as the other strands of the bundle so that the ends of all the strands are relatively even.

The method described above can be carried out by sewing a plurality of the tying elements 19 into appropriate locations on the rug backing and then tying a corresponding number of the bundles 15 to the rug backing using the sewed in tying elements. Alternatively, the method can be carried out by sewing a single tying element into the rug backing 13, tying a single bundle to the backing strip and thereafter repeating this process.

FIG. 9 shows an alternate way of attaching a plurality of tying elements 19 to the rug backing 13. To accomplish this, an elongated tying element strand 101 is sewed into the rug backing 13 manually having a conventional needle 103. The tying element strand 101 is sewed through or attached to the rug backing 13 at each of the dots 25 with the yarn between the dots 25 being loose and forming loops 105.

To convert the tying element strand 101 into a plurality of the tying elements 18 of equal lengths, the tying element strand is cut near the peaks or centers of the loops 105 using, for example, the scissors 57. Of course, the height of the loops 105 should be accurately controlled so that the resulting tying elements 19 will have the appropriate length in relation to the strands 17 of the bundles 15 so that when these tying elements are used to attach the bundles 15 to the rug backing 13, the free ends of the tying elements will extend beyond the knot 29 to form additional strands of the associated bundle with such additional strands extending for about the same distance from the rug backing as the other strands of the associated bundle.

The primary advantage of the technique illustrated in FIG. 9 is its increased speed. The increase in speed is obtained without requiring any additional tools. Preferably, the tying element strand 101 and the strands 17 of the bundles 15 which are to be attached to the rug backing 13 utilizing the tying elements formed from the tying element strand 101 are taken from the same filament, such as the same ball of yarn. After the tying elements 19 are provided as shown in FIG. 9, the remaining steps of the rug making method can be carried out as disclosed above in connection with FIGS. 3, 7 and 8.

Although an exemplary embodiment of the invention has been shown and described, many changes, modifications and substitutions may be made by one having ordinary skill in the art without necessarily departing from the spirit and scope of this invention.

I claim:

1. A method of making a rug comprising:

providing a rug backing having a forward face and a back face;

attaching a plurality of elongated flexible tying elements to the rug backing, the end portions of each of said tying elements extending from said rug backing;

providing a plurality of bundles of strands with said bundles being of predetermined lengths;

placing one of said bundles of strands adjacent the forward face of the rug backing and adjacent one of the tying elements;

wrapping said one tying element at least part way around a central region of said one bundle of strands;

tying a knot in said one tying element to attach said one bundle of strands to the forward face of the rug backing whereby said one bundle forms two clumps of pile on the forward face of the rug backing with said clumps being on opposite sides of said tying element and with each of said clumps being about one half of said predetermined length of said one bundle;

leaving the clumps unattached to the rug backing outwardly of said one tying element; and repeating said steps of wrapping, tying, and leaving to attach a multiplicity of the bundles of strands to the forward face of the rug backing.

2. A method as defined in claim 1 wherein said step of attaching includes sewing a tying element strand into said rug backing to form a plurality of loops on the forward face of the rug backing with the tying element strand being attached to the rug backing intermediate each of said loops and cutting said tying element strand at said loops to form a plurality of said tying elements each of which is attached to the rug backing.

3. A method as defined in claim 2 including providing a first elongated filament of material, separating a length of said first filament from said first filament to form said tying element strand and separating from said first filament a plurality of strands to form at least some of the bundles which are attached to said rug backing by tying elements formed from said tying element strand.

4. A method as defined in claim 1 wherein said one tying element consists of a single strand and said step of attaching includes manually sewing with a needle said one tying element into the rug backing by passing the needle one time completely through the rug backing whereby the free ends of said one tying element are on opposite sides of the location of the attachment of said one tying element to the rug backing.

5. A method as defined in claim 4 wherein said step of wrapping includes wrapping said one tying element a single time around a central region of said one bundle of strands.

6. A method as defined in claim 1 wherein said step of tying includes forming said knot so that the end portions of said one tying element extend beyond said knot to form additional strands of said one bundle with said additional strands terminating at about the ends of the other strands of said one bundle.

7. A method as defined in claim 1 wherein said step of providing a plurality of bundles of strands includes providing a template, wrapping a continuous filament around said template a plurality of times to form a multiplicity of loops of said filament, and cutting said loops to form at least one of said bundle of strands.

8. A method as defined in claim 7 including cutting each of said loops a plurality of times whereby each of said loops forms at least two of said bundles.

9. A method as defined in claim 7 wherein said template has cutting indicia thereon and said step of cutting includes cutting said loops where indicated by said cutting indicia.

10. A method as defined in claim 1 wherein said rug backing has a plurality of indicia thereon and said step of attaching includes sewing said tying elements onto said rug backing adjacent said indicia, respectively.

11. A method as defined in claim 7 including holding said loops in position on said template by providing a resilient band around said template and said loops.

12. A method as defined in claim 1 including applying adhesive to said one tying element and said one bundle of strands to reduce the likelihood that the strands of said one bundle will be pulled out from said one tying element.

13. A method as defined in claim 12 wherein said step of providing a plurality of bundles of strands includes providing a template, wrapping a continuous filament around said template a plurality of times to form a multiplicity of loops of said filament, and cutting said loops to form at least one of said bundle of strands, and said rug backing has a plurality of indicia thereon and said step of attaching includes sewing said tying elements onto said rug backing adjacent said indicia, respectively.

14. A method as defined in claim 13 wherein said step of wrapping includes wrapping said one tying element a single time around a central region of said one bundle of strands, and said step of tying includes forming said knot so that the end portions of said one tying element extend beyond said knot to form additional strands of said one bundle with said additional strands extending for about the same distance from the rug backing as the other strands of said one bundle.

15. A method as defined in claim 13 wherein said step of attaching includes sewing a tying element strand into said rug backing to form a plurality of loops on the forward face of the rug backing with the tying element strand being attached to the rug backing intermediate each of said loops and cutting said tying element strand at said loops to form a plurality of said tying elements each of which is attached to the rug backing.

16. A method of making a rug comprising:

providing a rug having a forward face and a back face;

attaching a plurality of elongated flexible tying elements to the rug backing, the end portions of each of said tying elements extending from said rug backing;

said rug backing having a plurality of indicia thereon and said step of attaching including sewing said tying elements onto said rug backing adjacent said indicia, respectively;

providing a template;

wrapping a continuous filament around said template a plurality of times to form a multiplicity of loops of said filament;

holding said loops in position on said template by providing a resilient band around said template and said loops;

cutting each of said loops a plurality of times whereby each of said loops forms at least two bundles of strands;

wrapping one of said tying elements a single time around a central region of one of said bundle of strands;

tying a knot in said one tying element to attach said one bundle of strands to the forward face of the rug backing whereby said one bundle forms two clumps of pile on the forward face of the rug backing with said clumps being on opposite sides of said tying element, said step of tying including forming said knot so that the end portions of said one tying element extend beyond said knot to form additional strands of said one bundle with said additional strands extending for about the same distance from the rug backing as the other strands of said one bundle; and repeating said steps of wrapping and tying to attach a multiplicity of the bundles of strands to the forward face of the rug backing.

17. A method of making a rug comprising:

providing a rug backing having a forward face and a back face;

attaching a plurality of elongated flexible tying elements to the rug backing, the end portions of each of said tying elements extending from said rug backing;

providing a plurality of bundles of strands;

wrapping one of the tying elements at least part way around a central region of one of the bundles of strands;

tying a knot in said one tying element to attach said one bundle of strands to the forward face of the rug backing whereby said one bundle forms two clumps of pile on the forward face of the rug backing with said clumps being on opposite sides of said tying element;

repeating said steps of wrapping and tying to attach a multiplicity of the bundles to the forward face of the rug backing; and said step of attaching including sewing a tying element strand into said rug backing to form a plurality of loops on the forward face of the rug backing with the tying element strand being attached to the rug backing intermediate each of said loops and cutting said tying element strand at said loops to form a plurality of said tying elements each of which is attached to the rug backing.

* * * * *